United States Patent [19]

Guenette

[11] 3,982,407

[45] Sept. 28, 1976

[54] GARBAGE CONTAINER UNIT

[75] Inventor: Jean Guy Guenette, Toronto, Canada

[73] Assignee: Lawrence Peska Associates, Inc., New York, N.Y. ; a part interest

[22] Filed: Jan. 7, 1975

[21] Appl. No.: 539,120

[52] U.S. Cl. ..... 62/441; 62/DIG. 15

[51] Int. Cl.[2] ..... F25D 11/00

[58] Field of Search ..... 62/DIG. 15, 447, 440, 62/441

[56] References Cited

UNITED STATES PATENTS

| | | | |
|---|---|---|---|
| 2,047,326 | 7/1936 | King | 62/447 |
| 2,112,221 | 3/1938 | Sargent | 62/317 |
| 2,302,051 | 11/1942 | Philipp | 62/518 |
| 2,340,780 | 2/1944 | Torbensen | 62/447 |
| 2,390,030 | 11/1945 | Paulson | 62/440 |
| 2,406,241 | 8/1946 | Morrison | 62/239 |
| 3,402,848 | 9/1968 | Busey | 220/63 R |

*Primary Examiner*—Lloyd L. King
*Attorney, Agent, or Firm*—Richard E. Nanfeldt

[57] ABSTRACT

A garbage container unit is used for storing individual garbage can members, wherein the exterior facing of unit simulates the color and texture of a picket fence. The unit is placed between two sections of the picket fence. The unit comprises an open top rectangular box having a hingably mounted cover wherein the base of the unit has a plurality of drainage opening therethrough. A refrigerant unit is contained within the unit for slowing down the organic decomposition of the garbage. The interior chamber of the unit is subdivided into a plurality of smaller compartments by vertically placed partition boards. The individual garbage can members insert into the compartments of the unit. Each garbage can member comprises an open top cylindrical member having a closed bottom. The closed bottom has a plurality of drainage holes therethrough. A dome shaped cover is hingably mounted to a top rim of the cylindrical member.

5 Claims, 5 Drawing Figures

GARBAGE CONTAINER UNIT

SUMMARY OF THE INVENTION

My invention relates to a unique and novel means for storing garbage.

A number of U.S. Pat. Nos. 2,441,833; 3,402,848; 3,647,102; and 3,648,879 have been employed for storing garbage, but these aforementioned patents are non-related to my present invention.

An object of my present invention is to provide a unit for storing garbage, wherein the unit has an exterior design similar to a fence.

A further object of my present invention is to provide a unit for storing garbage, wherein a means is provided for cooling the garbage unit.

A still further object of my invention is to provide a two safety lock for the garbage container unit.

Another object of my present invention is to provide individual compartments within the units, wherein individual garbage can members can be stored.

Briefly, my present invention comprises a garbage container unit used for storing individual garbage can members, wherein the exterior facing of unit simulates the color and texture of a picket fence. The unit is placed between two sections of the picket fence. The unit comprises an open top rectangular box having a hingably mounted cover, wherein the base of the unit has a plurality of drainage opening therethrough. A refrigerant unit is obtained within the unit for slowing down the organic decomposition of the garbage. The interior chamber of the unit is subdivided into a plurality of smaller compartments by vertically placed partition boards. The individual garbage can members insert into the compartments of the unit. Each garbage can member comprises an open top cylindrical member having a closed bottom. The closed bottom has a plurality of drainage holes therethrough. A dome shaped cover is hingably mounted to a top rim of the cylindrical member.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
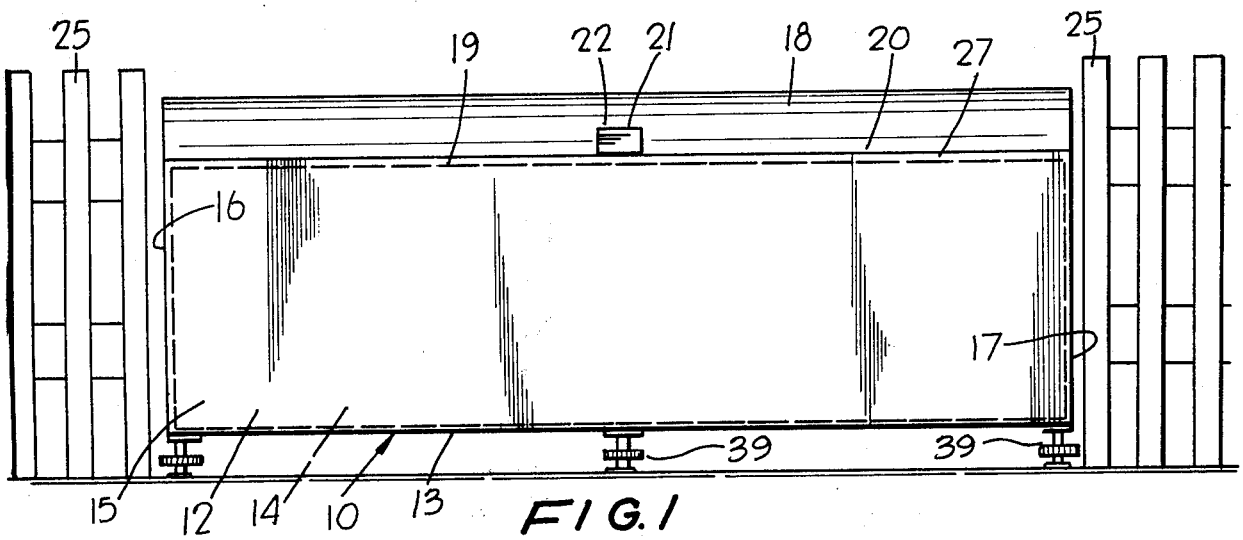
FIG. 1 illustrates a front cross sectional view of the garbage container unit.
Figure 2:
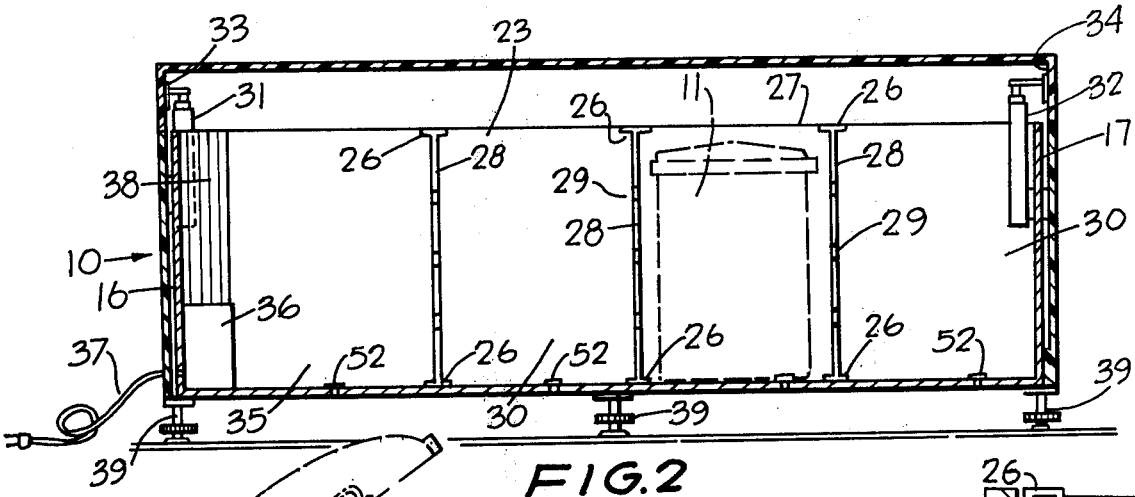
FIG. 2 illustrates a front cross sectional view of a garbage can member contained within the garbage container unit.
Figure 5:
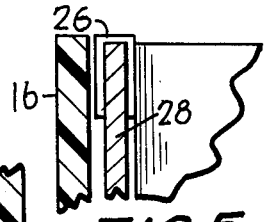
FIG. 5 illustrates a front sectional view of the partitions of the garbage container unit.

Turning now descriptively to the drawings, in which similar reference characters denote similar elements throughout the several views, FIGS. 1–2 show a garbage container unit 10 used for storing individual garbage can members 11 under refrigerated conditions. The unit 10 comprises an open top rectangular box 12 having a bottom base 13, two upper extending vertical sidewalls 14, 15 and two upper extending vertical end walls 16, 17. The base 13 and walls 14, 15, 16, 17 of the box 12 define an interior rectangular chamber 23. A half cylindrical shaped top cover 18 is hingably mounted onto the top edge 19 of the back sidewall 15 of the box 12. A safety lock 21 is affixed to the front center bottom edge 20 of the cover 18, wherein he lock 21 communicates with a lock bracket 22 mounted on the top inside of the front sidewall 15 of the box 12. The safety lock 21 is designed for opening from the exterior of the box 12 on the interior chamber 23 of the box 12. The exterior surface of the cover 18 and box 12 is a decorative thermoplastic covering of similar color and texture to a fence 25, wherein the unit 10 is inserted between two portions of the fence 25. A plurality of horizontally placed channel brackets 26 are affixed to the inside surface of the base 13 and between the top edges 19, 27 of the sidewalls 14, 15 of the box 12 as shown in FIG. 5. A plurality of vertically placed rectangular shaped partition boards 28 having air passages 29 therethrough insert into the bracket 26, wherein chamber 23 is divided into a plurality of smaller compartments 30. A pair of door check units 31, 32 communicate between the top inside end walls 16, 17 and the ends 33, 34 of the cover 18. In the left compartment 35, an electric motor 36 having an outlet cord 37 communicates with a refrigerant unit 38. The regrigerant unit 38 keeps the compartments 30 cool, thereby slowing down the organic decomposition of the garbage. The bottom base 13 has a plurality of drainage holes 52 therethrough.

Figure 4:
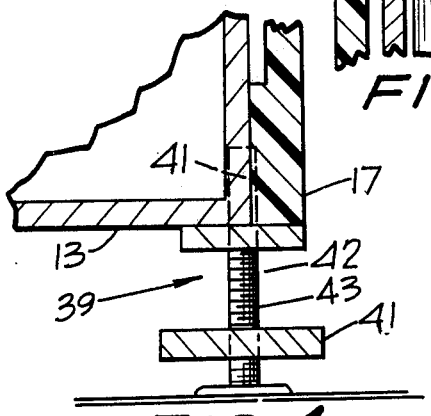
FIG. 4 illustrates a cross sectional view of a foot leveling member of the garbage container unit.

A plurality of self-leveling foot members 39 communicates with the bottom base 13 of the box 12 as shown in FIG. 4. A flat reinforcing member 40 is joined to the bottom face of base 13, wherein a threaded aperture 41 extends upward through member 40 and base 13. A horizontally placed rod 42 having a threaded outer surface 43 threadedly engages aperture 41, wherein a disc member 44 is affixed to the bottom of rod 42. A locking nut 41 is contained on rod 42 between members 40, 44.

Figure 3:
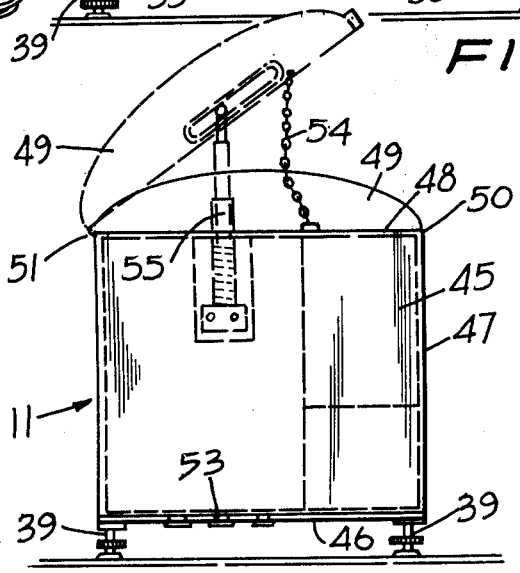
FIG. 3 illustrates a front cross sectional view of a garbage can member.

The garbage can member 11 as shown in FIG. 3 comprises a cylindrical shaped unit 45 having a closed bottom 46, upward extending annular sidewall wall 47, and an open top 48. A dome shaped cover 49 is hingably mounted onto a top rim 50 of sidewall 47. A rubber seal gasket 51 is affixed to rim 50. A plurality of self locking foot members 39 are affixed to the closed bottom 46. The closed bottom 46 has a plurality of drainage openings 53 therethrough. A retaining chain 54 communicates between rim 50 and cover 49. A two sectional telescopic arm assembly 55 communicates between the sidewall 47 and the cover 49. The garbage can member 11 are stored in the compartments 30 of the unit 10 as shown in FIG. 2.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A garbage container unit, which comprises:

a. a rectangularly shaped open top box having a bottom base with a plurality of drainage holes therein, a pair of upwardly extending vertical endwalls, a pair of upwardly extending vertical sidewalls, said base, said endwalls and said sidewalls defining a rectangularly shaped chamber therein;

b. a plurality of horizontally placed channel brackets affixed to an upper inside surface of said bottom base, said channel brackets additionally affixed to the top edges of said vertical sidewalls;

c. a plurality of vertically placed rectangularly shaped partition boards having air passageways therethrough, said partition board detachably mounted in said channel brackets for dividing said rectangularly shaped chamber into a plurality of smaller compartments, said smaller compartments varying in dimensions according to placement of said partition boards;

d. a cover hingably mounted onto one said sidewall of said box;

e. a cooling means contained in one said smaller compartment, said cooling means including an electric motor communicating a refrigerant unit, cool air from said refrigerant passing through said air passageways from one said smaller compartment to another said smaller compartment;

f. a plurality of garbage can members, one said garbage can member contained in each said smaller compartment; and g. a plurality of self leveling foot members affixed to said base of said box, each said foot member including a flat reinforcing member joined to a bottom face of said base, wherein a threaded aperture extends upwardly through said reinforcing member into said base, a horizontally placed rod having a threaded outer surface, said rod threadably engaging into said aperture, a disc member affixed to a bottom of said rod, and a locking nut contained on said rod between said reinforcing member and said disc.

2. A garbage container unit as recited in claim 1, wherein said cover is of a half cylindrical shape.

3. A garbage container unit as recited in claim 1, wherein said cover and said box have a colored thermoplastic coating deposited thereon.

4. A garbage container unit as recited in claim 1, wherein said garbage can member further comprises:

a. a cylindrical shaped unit having a closed bottom and an open top;

b. a dome shaped cover hingably mounted to said cylindrical shaped unit; and c. said closed bottom having a plurality of drainage openings therethrough.

5. A garbage container unit as recited in claim 4, wherein each said garbage can member still further comprises:

a. a chain affixed between said dome shaped cover and said cylindrical shaped unit;

b. a two sectional telescopic arm communicating between said dome shaped cover and said cylindrical shaped unit; and c. a plurality of said self leveling foot members affixed to said closed bottom.

* * * * *